US012781152B2

(12) United States Patent
Djellouli et al.

(10) Patent No.: US 12,781,152 B2
(45) Date of Patent: Nov. 3, 2026

(54) SMART HYDRAULICS

(71) Applicant: President and Fellows of Harvard College, Cambridge, MA (US)

(72) Inventors: Abderrahmane Adel Tayeb Djellouli, Cambridge, MA (US); Katia Bertoldi, Cambridge, MA (US); Bert Van Raemdonck, Cambridge, MA (US); Benjamin Gorissen, Cambridge, MA (US)

(73) Assignee: President and Fellows of Harvard College, Cambridge, MA (US)

( * ) Notice: Subject to any disclaimer, the term of this patent is extended or adjusted under 35 U.S.C. 154(b) by 44 days.

(21) Appl. No.: 18/825,135

(22) Filed: Sep. 5, 2024

(65) Prior Publication Data

US 2025/0115826 A1 Apr. 10, 2025

Related U.S. Application Data

(60) Provisional application No. 63/588,408, filed on Oct. 6, 2023.

(51) Int. Cl.

| | |
|---|---|
| ***C10M 171/06*** | (2006.01) |
| *C10N 20/06* | (2006.01) |
| *C10N 40/08* | (2006.01) |

(52) U.S. Cl.

CPC ..... *C10M 171/06* (2013.01); *C10N 2020/06* (2013.01); *C10N 2040/08* (2013.01)

(58) Field of Classification Search

CPC ..... C10N 2030/02; C10N 2020/02; C10N 2020/06; C10N 2030/06; C10N 2040/24; C10N 2050/015; C10N 2050/12; C10N 2040/08; C10M 171/06; C10M 2201/02

See application file for complete search history.

(56) References Cited

PUBLICATIONS

Benichou et al., "Structures undergoing discrete phase transformation." Journal of the Mechanics and Physics of Solids 61.1: 94-113 (2013).

Bertoldi et al., Flexible mechanical metamaterials. Nature Reviews Materials (2017).

Brunet et al., "Soft 3D acoustic metamaterial with negative index." Nature materials 14.4: 384-388 (2015).

Chen et al., "Robust fabrication of ultra-soft tunable PDMS microcapsules as a biomimetic model for red blood cells." Soft Matter 19.28: 5249-5261 (2023).

Chen et al., "Metamaterials application in sensing." Sensors 12.3: 2742-2765 (2012).

Chen et al., "Metamaterials-based enhanced energy harvesting: A review." Physica B: Condensed Matter 438: 1-8 (2014).

Chien et al., "Abnormal rheology of oxygenated blood in sickle cell anemia." The Journal of clinical investigation 49.4: 623-634 (1970).

(Continued)

*Primary Examiner* — Vishal V Vasisth

(74) *Attorney, Agent, or Firm* — Nixon Peabody LLP

(57) ABSTRACT

A metafluid includes a fluid exposed to a plurality of loads, each load of the plurality of loads causing a respective pressure change within the fluid. One or more compressible capsules are suspended within the fluid. Each capsule of the one or more compressible capsules has an external shell configured to withstand a cyclic elastic deformation. The external shell changes between a first shape and a second shape when a predetermined load occurs in the plurality of loads.

24 Claims, 13 Drawing Sheets

(56) References Cited

PUBLICATIONS

Cho et al., "Using highly uniform and smooth selenium colloids as low-loss magnetodielectric building blocks of optical metafluids." Optics Express 25.12: 13822-13833 (2017).
Christensen et al., "Vibrant times for mechanical metamaterials." Mrs Communications 5.3: 453-462 (2015).
Cortes et al., "Optical metasurfaces for energy conversion." Chemical reviews 122.19: 15082-15176 (2022).
Craster et al., Acoustic metamaterials: negative refraction, imaging, lensing and cloaking. vol. 166. Springer Science & Business Media (2012).
Deymier. Acoustic metamaterials and phononic crystals. vol. 173. Springer Science & Business Media (2013).
Dressaire et al., "Clogging of microfluidic systems." Soft matter 13.1: 37-48 (2017).
Engheta et al., Metamaterials: physics and engineering explorations. John Wiley & Sons (2006).
Fan et al., "Three-dimensional all-dielectric metamaterial solid immersion lens for subwavelength imaging at visible frequencies." Science Advances 2.8: e1600901 (2016).
Fowler et al., "High efficiency ambient RF energy harvesting by a metamaterial perfect absorber." Optical Materials Express 12.3: 1242-1250 (2022).
Guazzelli., A physical introduction to suspension dynamics. vol. 45. Cambridge University Press (2011).
Hinamoto et al., "Colloidal solutions of silicon nanospheres toward all-dielectric optical metafluids." Nano Letters 20.10: 7737-7743 (2020).
Hu et al., "Acoustic-elastic metamaterials and phononic crystals for energy harvesting: A review." Smart Materials and Structures 30.8: 085025 (2021).
Muamer et al., "Metamaterials beyond electromagnetism." Reports on Progress in physics 76.12: 126501 (2013).
Kim et al., "Limitations and opportunities for optical metafluids to achieve an unnatural refractive index." ACS Photonics 4.9: 2298-2311 (2017).
Lee et al., "Piezoelectric energy harvesting using mechanical metamaterials and phononic crystals." Communications Physics 5.1: 94 (2022).
Lin et al., "Structured graphene metamaterial selective absorbers for high efficiency and omnidirectional solar thermal energy conversion." Nature communications 11.1: 1389 (2020).
Maldovan. "Narrow low-frequency spectrum and heat management by thermocrystals." Physical review letters 110.2: 025902 (2013).
Moleron et al., "Acoustic metamaterial for subwavelength edge detection." Nature communications 6.1: 8037 (2015).
Nagelberg et al., "Reconfigurable and responsive droplet-based compound micro-lenses." Nature communications 8.1: 14673 (2017).
Patel et al., "Optimization of metamaterial-based solar energy absorber for enhancing solar thermal energy conversion using artificial intelligence." Advanced Theory and Simulations 5.8: 2200139 (2022).
Peretz et al., "A metafluid with multistable density and internal energy states." Nature Communications 13.1: 1810 (2022).
Puglisi et al., "Mechanics of a discrete chain with bi-stable elements." Journal of the Mechanics and Physics of Solids 48.1: 1-27 (2000).
Ramahi et al., "Metamaterial particles for electromagnetic energy harvesting." Applied Physics Letters 101. 17 (2012).
Sheikholeslami et al., "A metafluid exhibiting strong optical magnetism." Nano letters 13.9: 4137-4141 (2013).
Shewan et al., "Analytically predicting the viscosity of hard sphere suspensions from the particle size distribution." Journal of Non-Newtonian Fluid Mechanics 222: 72-81 (2015).
Shewan et al., "Viscosity of soft spherical micro-hydrogel suspensions." Journal of colloid and interface science 442: 75-81 (2015).
Urzhumov et al., "Plasmonic nanoclusters: a path towards negative-index metafluids." Optics express 15.21: 14129-14145 (2007).
Utada et al., "Monodisperse double emulsions generated from a microcapillary device." Science 308.5721: 537-541 (2005).
Yang et al., "Broadband absorbing exciton-plasmon metafluids with narrow transparency windows." Nano letters 16.2: 1472-1477 (2016).
Xu et al., "Multifunctional metamaterials for energy harvesting and vibration control." Advanced Functional Materials 32.7: 2107896 (2022).

SMART HYDRAULICS

CROSS-REFERENCE TO RELATED APPLICATIONS

This application claims priority to and the benefit of U.S. Provisional Application No. 63/588,408, filed on Oct. 6, 2023, which is incorporated herein by reference in its entirety.

STATEMENT REGARDING FEDERALLY SPONSORED RESEARCH

This invention was made with government support under 2011754 awarded by National Science Foundation (NSF). The government has certain rights in this invention.

FIELD OF THE INVENTION

The present invention relates generally to a metafluid, and in particular to a metafluid having compressible capsules suspended in a fluid.

BACKGROUND OF THE INVENTION

The pursuit of materials having enhanced functionality has led to the emergence of artificially engineered materials whose properties are determined by structure rather than by composition. Such artificially engineered materials are commonly referred to as metamaterials. Through careful design of their building blocks, metamaterials with unprecedented electro-magnetic, acoustic, thermal, and mechanical properties have been realized. Metamaterials have the potential to revolutionize fields, for example without limitation, ranging from energy harvesting and conversion to sensing and imaging. Traditionally, metamaterials are constructed by arranging building blocks in fixed positions within a lattice structure. However, recent research has revealed the potential of mixing unconnected building blocks in a fluidic medium to produce metafluids.

Metafluids have shown reconfigurable and adaptable photonic properties, negative acoustic indices, and unconventional thermodynamic properties. Unlike solid metamaterials, metafluids can flow to take the shape of their container and do not require a precise arrangement of their building blocks. A need exists for a metafluid having a programmable non-linear and hysteretic response to pressure that can be tailored for specific purposes and applications. The present disclosure provides a solution to these and other needs.

SUMMARY OF THE INVENTION

The term embodiment and like terms, e.g., implementation, configuration, aspect, example, and option, are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter. This summary is also not intended to be used in isolation to determine the scope of the claimed subject matter. The subject matter should be understood by reference to appropriate portions of the entire specification of this disclosure, any or all drawings, and each claim.

According to certain aspects of the present disclosure, a metafluid includes a fluid exposed to a plurality of loads, each load of the plurality of loads causing a respective pressure change within the fluid. One or more compressible capsules are suspended within the fluid. Each capsule of the one or more compressible capsules has an external shell configured to withstand a cyclic elastic deformation. The external shell changes between a first shape and a second shape when a predetermined load occurs in the plurality of loads.

According to some features of the above aspects, the external shell has an enclosed internal volume and is deformable under pressure to withstand a first elastic deformation from the first shape to the second shape. The external shell is further deformable under pressure to withstand a second elastic deformation from the second shape to the first shape.

According to some features of the above aspects, the first elastic deformation occurs at a constant volume or a constant pressure of the metafluid.

According to some features of the above aspects, the first shape is an original shape and the second shape is a deformed shape. The first elastic deformation is the result of increasing the pressure from less than a critical buckling pressure to the critical buckling pressure. The second elastic deformation is the result of decreasing the pressure from more than a critical expansion pressure to the critical expansion pressure.

According to some features of the above aspects, the deformed shape is one of a plurality of deformed shapes.

According to some features of the above aspects, the internal volume of the deformed shape decreases with increasing the pressure.

According to some features of the above aspects, the critical expansion pressure is less than the critical buckling pressure.

According to some features of the above aspects, a capsule volume fraction is defined as a sum of external volumes of the one or more compressible capsules each having the first shape divided by a total volume of the metafluid. The critical buckling pressure is independent of the capsule volume fraction.

According to some features of the above aspects, viscosity of the metafluid is dependent on the pressure of the metafluid.

According to some features of the above aspects, the viscosity of the metafluid increases when the pressure increases from less than the critical buckling pressure to the critical buckling pressure, and the viscosity of the metafluid decreases when the pressure decreases from more than the critical expansion pressure to the critical expansion pressure. This viscosity aspect occurs typically at low-shear rates. However, at high-shear rates, the opposite effect occurs. In other words, the viscosity decreases when the pressure increases and the viscosity increases when the pressure decreases.

According to some features of the above aspects, the viscosity of the metafluid is dependent on the shear stress applied to the metafluid.

According to some features of the above aspects, the metafluid exhibits non-Newtonian shear thinning fluid behavior at a shear stress equal to or greater than the transition shear stress, $\sigma_T$.

According to some features of the above aspects, transmittance of light through the metafluid is dependent on the pressure of the metafluid.

According to some features of the above aspects, the transmittance of light through the metafluid increases when the pressure increases from less than the critical buckling pressure to the critical buckling pressure, and the transmittance of light through the metafluid decreases when the pressure decreases from more than the critical expansion pressure to the critical expansion pressure.

According to some features of the above aspects, transmittance of sound through the metafluid is dependent on the pressure of the metafluid.

According to some features of the above aspects, the transmittance of sound through the metafluid increases when the pressure increases from less than the critical buckling pressure to the critical buckling pressure, and the transmittance of sound through the metafluid decreases when the pressure decreases from more than the critical expansion pressure to the critical expansion pressure.

According to some features of the above aspects, a gas is fully enclosed within the external shell.

According to some features of the above aspects, the gas is air.

According to some features of the above aspects, the critical buckling pressure is determined by material properties of the external shell, a ratio of the wall thickness to the radius of the external shell, and an internal pressure of the gas within the external shell.

According to some features of the above aspects, a liquid is fully enclosed within the external shell.

According to some features of the above aspects, the liquid is water.

According to some features of the above aspects, the critical buckling pressure is determined by material properties of the external shell, a ratio of the wall thickness to the radius of the external shell, and an internal pressure of the liquid within the external shell.

According to some features of the above aspects, the one or more compressible capsules are spherical.

According to some features of the above aspects, the external shell of a first subset of the one or more compressible capsules is made from a first material having a first shear modulus and a first ratio of the wall thickness to the radius of the external shell, and the external shell of a second subset of the one or more compressible capsules is made from a second material having a second shear modulus and a second ratio of the wall thickness to the radius of the external shell.

According to certain aspects of the present disclosure, a capsule for suspension within a fluid has an external shell with an enclosed internal volume. The external shell is deformable under pressure to withstand a first elastic deformation from a first original shape having a first internal volume to a second deformed shape having a second internal volume, and a second elastic deformation from the second deformed shape back to the first original shape. The first elastic deformation is the result of increasing the pressure to a critical buckling pressure, the second elastic deformation being the result of decreasing the pressure to a critical expansion pressure.

According to some features of the above aspects, the second deformed shape is one of a plurality of second deformed shapes.

According to some features of the above aspects, the internal volume of the second deformed shape decreases with increasing the pressure.

According to some features of the above aspects, the critical expansion pressure is less than the critical buckling pressure.

According to some features of the above aspects, the capsule is spherical.

According to some features of the above aspects, a gas is fully enclosed within the external shell.

According to some features of the above aspects, the critical buckling pressure is determined by material properties of the external shell, a ratio of the wall thickness to the radius of the external shell, and an internal pressure of the gas within the external shell.

According to some features of the above aspects, a liquid is fully enclosed within the external shell.

According to some features of the above aspects, the critical buckling pressure is determined by material properties of the external shell, a ratio of the wall thickness to the radius of the external shell, and an internal pressure of the liquid within the external shell.

The above summary is not intended to represent each embodiment or every aspect of the present disclosure. Rather, the foregoing summary merely provides an example of some of the novel aspects and features set forth herein. The above features and advantages, and other features and advantages of the present disclosure, will be readily apparent from the following detailed description of representative embodiments and modes for carrying out the present invention, when taken in connection with the accompanying drawings and the appended claims. Additional aspects of the disclosure will be apparent to those of ordinary skill in the art in view of the detailed description of various embodiments, which is made with reference to the drawings, a brief description of which is provided below.

BRIEF DESCRIPTION OF THE DRAWINGS

The disclosure, and its advantages and drawings, will be better understood from the following description of representative embodiments together with reference to the accompanying drawings. These drawings depict only representative embodiments and are therefore not to be considered as limitations on the scope of the various embodiments or claims.

DETAILED DESCRIPTION

Figure 1:
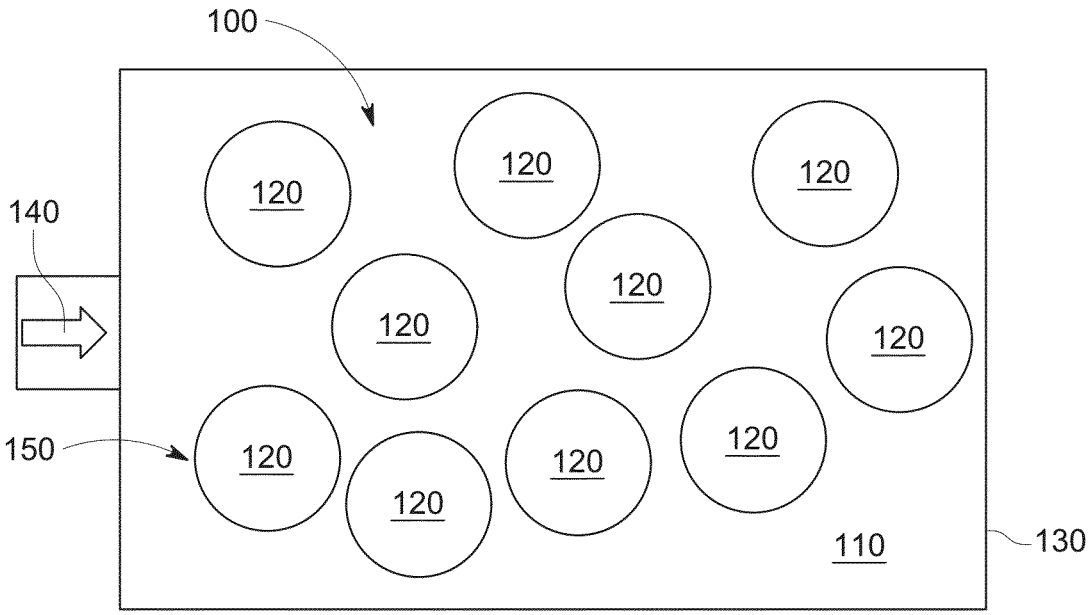
FIG. 1 shows a schematic view of a metafluid within a container, according to certain aspects of the present disclosure.

Various embodiments are described with reference to the attached figures, where like reference numerals are used throughout the figures to designate similar or equivalent elements. The figures are not necessarily drawn to scale and are provided merely to illustrate aspects and features of the present disclosure. Numerous specific details, relationships, and methods are set forth to provide a full understanding of certain aspects and features of the present disclosure, although one having ordinary skill in the relevant art will recognize that these aspects and features can be practiced without one or more of the specific details, with other relationships, or with other methods. In some instances, well-known structures or operations are not shown in detail for illustrative purposes. The various embodiments disclosed herein are not necessarily limited by the illustrated ordering of acts or events, as some acts may occur in different orders and/or concurrently with other acts or events. Furthermore, not all illustrated acts or events are necessarily required to implement certain aspects and features of the present disclosure.

For purposes of the present detailed description, unless specifically disclaimed, and where appropriate, the singular includes the plural and vice versa. The word "including" means "including without limitation." Moreover, words of approximation, such as "about," "almost," "substantially," "approximately," and the like, can be used herein to mean "at," "near," "nearly at," "within 3-5% of," "within acceptable manufacturing tolerances of," or any logical combination thereof. Similarly, terms "vertical" or "horizontal" are intended to additionally include "within 3-5% of" a vertical or horizontal orientation, respectively. Additionally, words of direction, such as "top," "bottom," "left," "right," "above," and "below" are intended to relate to the equivalent direction as depicted in a reference illustration; as understood contextually from the object(s) or element(s) being referenced, such as from a commonly used position for the object(s) or element(s); or as otherwise described herein.

As disclosed herein, a metafluid can be realized by mixing deformable capsules into an incompressible fluid. Such a metafluid can be tailored or programmed to meet the needs of a wide variety of new applications, including metafluid-based programmable solutions for use in hydraulics, optics, acoustics, fluid dynamics, thermodynamics, switching, and even logic. The metafluid is programmable, at least in part, by the nature of the building blocks in suspension. For example without limitation, building blocks that reversibly buckle can provide a non-linear and hysteretic response to pressure that can be tailored for specific purposes and applications.

As further disclosed herein, by mixing highly deformable spherical capsules into an incompressible fluid, a metafluid with programmable elastic response, optical behavior, and viscosity can be realized. It is disclosed that reversible buckling of the shells radically changes the characteristics of the fluid and provides exciting opportunities to expand its functionality.

Referring to FIG. 1, a metafluid 100 includes a fluid 110 and one or more compressible capsules 120 suspended within the fluid 110. The metafluid 100 is illustrated, for example, disposed within a container 130. The fluid 110 is exposed to a plurality of loads, for example, by incrementally adding fluid 110 into the container 130 as indicated by the arrow 140. As a further example, for each load of the plurality of loads, an incremental increase in the amount of added fluid 110 causes an increase in pressure within the fluid 110.

Figure 2:
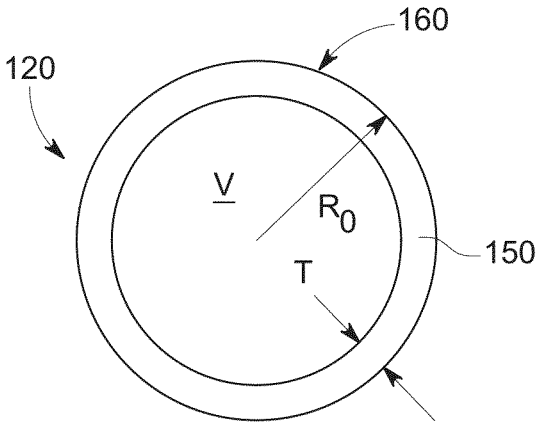
FIG. 2 shows a cross-sectional representation of an exemplary compressible capsule, according to certain aspects of the present disclosure.

Referring to FIG. 2, each of the compressible capsules 120 has an external shell 150, according to one embodiment. The compressible capsules 120 are configured to withstand a cyclic elastic deformation, with the external shell 150 changing between a first shape and a second shape when a predetermined load occurs in the plurality of loads. For example, at least one compressible capsule 120 has a spherical shape. In other embodiments, the compressible capsules 120 have other first shapes, such as and without limitation, an ellipsoid shape, an ovoid shape, or a disk shape.

The compressible capsule 120 has an external surface 160 with a radius indicated by $R_0$, and the external shell 150 has a wall thickness indicated by T. For example, according to one illustrative example, the radius $R_0$ is about 30 millimeters ("mm") and the thickness T is about 6 mm. In another example, the radius $R_0$ is about 10 mm and the thickness T is about 2 mm. In yet another example, the radius $R_0$ is about 250 micrometers ("μm") and the thickness T is about 65 μm. The radius $R_0$ and the wall thickness T can be sized as desired for particular operating conditions or a particular application. Regardless of the first shape of the compressible capsule 120, the external shell 150 has an enclosed internal volume, as indicated by V in FIG. 2.

Referring generally to FIGS. 3A-6B, exemplary compressible capsules 120 are illustrated in the same state of compression. Referring specifically to FIGS. 3A-4B, according to one example, the external shell 150 is deformable under pressure to withstand a first elastic deformation from a first shape (shown in FIGS. 3A-3B) to a second shape (shown in FIGS. 4A-4B). Referring specifically to FIGS. 5A-6B, according to another example, the external shell 150 is further deformable under pressure to withstand a second elastic deformation from a second shape (shown in FIGS. 5A-6B) to the first shape (shown in FIGS. 3A-3B).

Figure 3A:
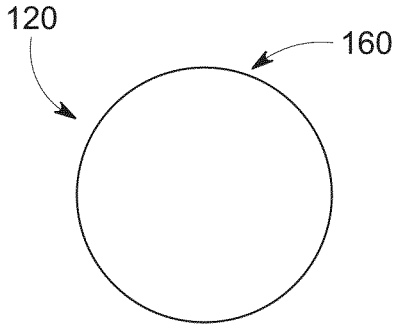
FIG. 3A shows a perspective view of a compressible capsule having a first shape, according to certain aspects of the present disclosure.
Figure 3B:
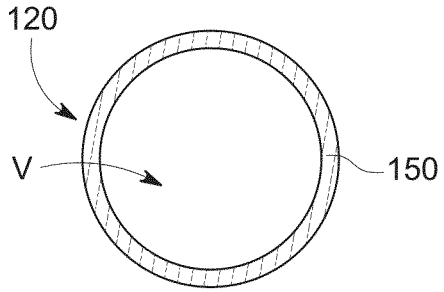
FIG. 3B shows a cross-sectional representation of the compressible capsule of FIG. 3A.

Referring specifically to FIGS. 3A-3B, the first shape of the external shell 150 is an original shape, such as a spherical shape. Referring specifically to FIGS. 4A-6B, the second shape of the external shell 150 is a deformed shape that is one of a plurality of deformed shapes. The first elastic deformation of the external shell 150, such as the change in shape between FIGS. 3A-3B and 4A-4B, is the result of increasing the pressure on the external shell 150 from (i) a pressure that is less than a critical buckling pressure to (ii) the critical buckling pressure.

Figure 4A:
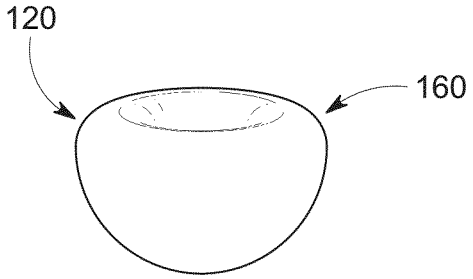
FIG. 4A shows a perspective view of a compressible capsule having a second shape, according to certain aspects of the present disclosure.
Figure 4B:
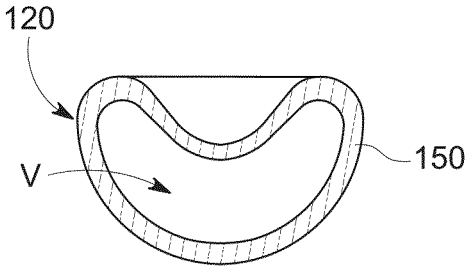
FIG. 4B shows a cross-sectional representation of the compressible capsule of FIG. 4A.
Figure 5A:
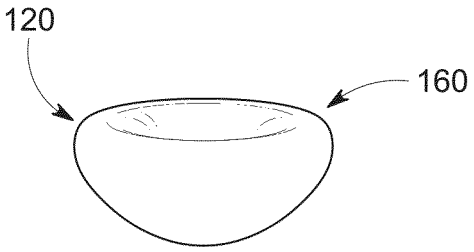
FIG. 5A shows a perspective view of a compressible capsule having another second shape, according to certain aspects of the present disclosure.
Figure 5B:
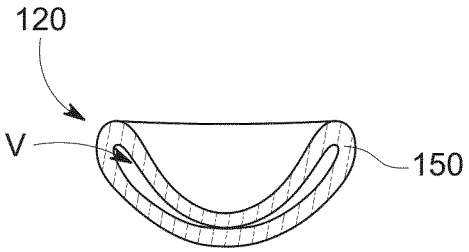
FIG. 5B shows a cross-sectional representation of the compressible capsule of FIG. 5A.
Figure 7:
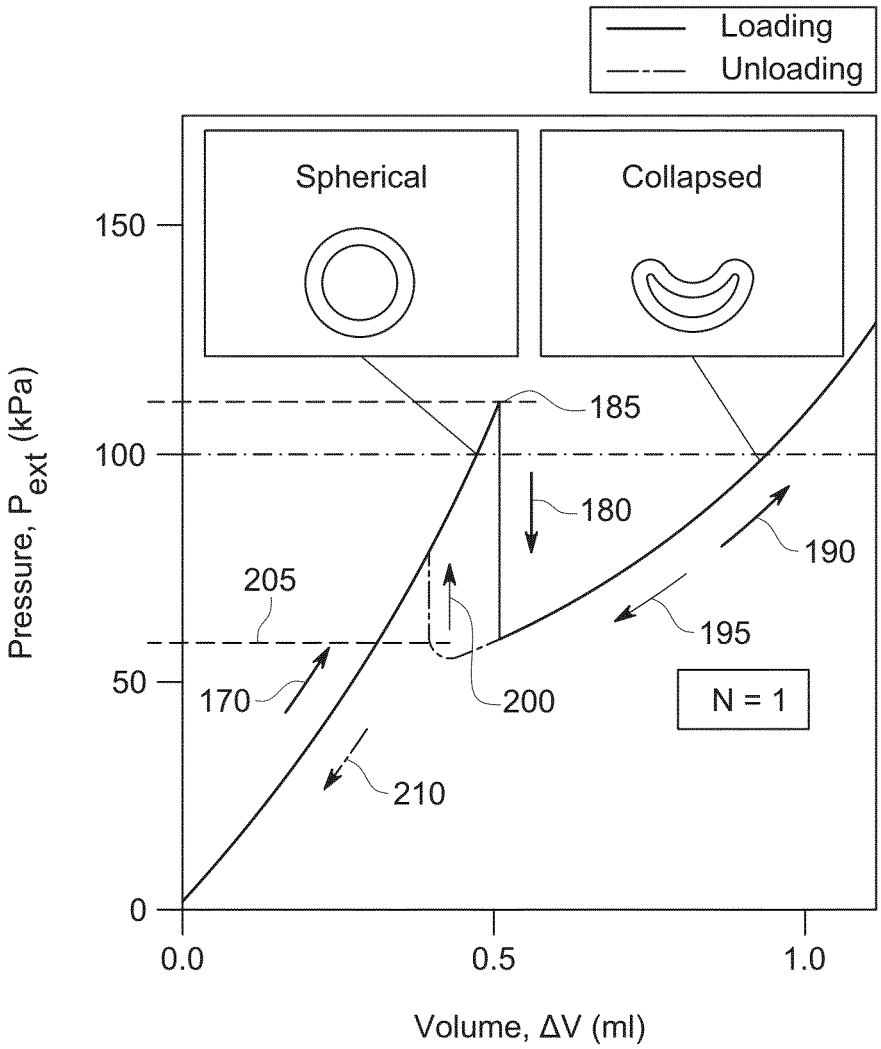
FIG. 7 shows an exemplary graph of pressure vs. volume response for a metafluid having a single compressible capsule, according to certain aspects of the present disclosure.

Referring to FIG. 7, an exemplary graph illustrates applied pressure in a metafluid 100 that has a single compressible capsule 120. The graph shows the applied pressure vs. an incremental increase in volume (ΔV) of the fluid 110 (shown in FIG. 1). Starting at the lower left corner of the graph, as additional fluid 110 is added to the container 130 (shown in FIG. 1), the exemplary pressure rises as indicated by the arrow 170. During the pressure rise 170, the external shell 150 may compress but maintains the first shape, which in this example is spherical. When the exemplary pressure has risen, for example, to a hypothetical pressure of just over 100 kiloPascals ("kPa") as shown on the graph, the external shell 150 buckles under the pressure and elastically deforms from its first shape (e.g., as shown in FIGS. 3A-3B) to its second shape (e.g., as shown in FIGS. 4A-4B). This buckling of the external shell 150 is accompanied by an instantaneous decrease in the exemplary pressure, as indicated by the arrow 180. The pressure at which the external shell 150 buckles is the critical buckling pressure 185.

Following the instantaneous decrease in pressure at 180, additional fluid 110 added to the container 130 causes the exemplary pressure to rise again, as indicated by the arrow 190. As the exemplary pressure rises, the internal volume V of the deformed shape of the external shell 150 decreases, for example, as shown by the decrease in volume V between FIGS. 4A-4B and FIGS. 5A-5B.

Still referring to FIG. 7, starting to the right of the instantaneous pressure decrease 180, if the incremental increase in volume (ΔV) of the fluid 110 is reversed so that ΔV is negative, the exemplary pressure decreases as indicated by the arrow 195. As the exemplary pressure decreases, the internal volume V of the deformed shape of the external shell 150 increases, for example, as shown by the increase in volume V between FIGS. 5A-5B and FIGS. 6A-6B. Furthermore, as the change in volume ΔV and the associated pressure decrease in the direction of the arrow 195, the change in volume ΔV decreases beyond a value associated with the instantaneous decrease in pressure 180. This means that the external shell 150 remains in a second shape. The second shape is at a value of ΔV below the value of ΔV associated with the pressure decrease 180, and at a pressure below the critical buckling pressure 185.

Figure 6A:
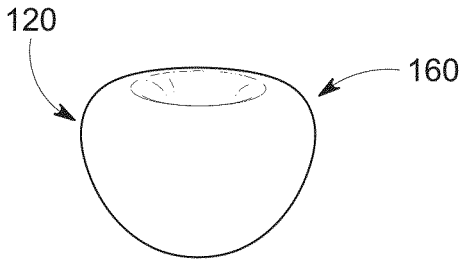
FIG. 6A shows a perspective view of a compressible capsule having a further second shape, according to certain aspects of the present disclosure.
Figure 6B:
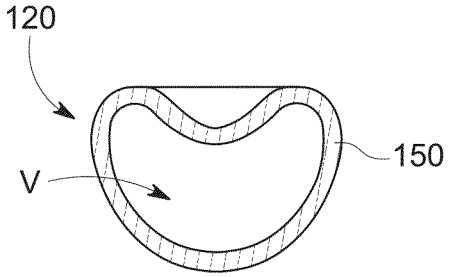
FIG. 6B shows a cross-sectional representation of the compressible capsule of FIG. 6A.

Continuing to decrease ΔV in the direction of the arrow 195, at a predetermined pressure the external shell 150 expands and elastically deforms from the second shape (e.g., as shown in FIGS. 6A-6B) back to the first shape (e.g., as shown in FIGS. 3A-3B). This expansion of the external shell 150 is accompanied by an instantaneous increase in the exemplary hypothetical pressure, as indicated by the arrow 200. The pressure at which the external shell 150 expands is the critical expansion pressure 205. According to an exemplary embodiment, the critical expansion pressure 205 is less than the critical buckling pressure 185. After the external shell 150 has expanded back to the first shape, further decreases in ΔV result in the pressure decreasing as shown by the arrow 210, which is opposite to the initial increase of pressure along the arrow 170.

Figure 8:
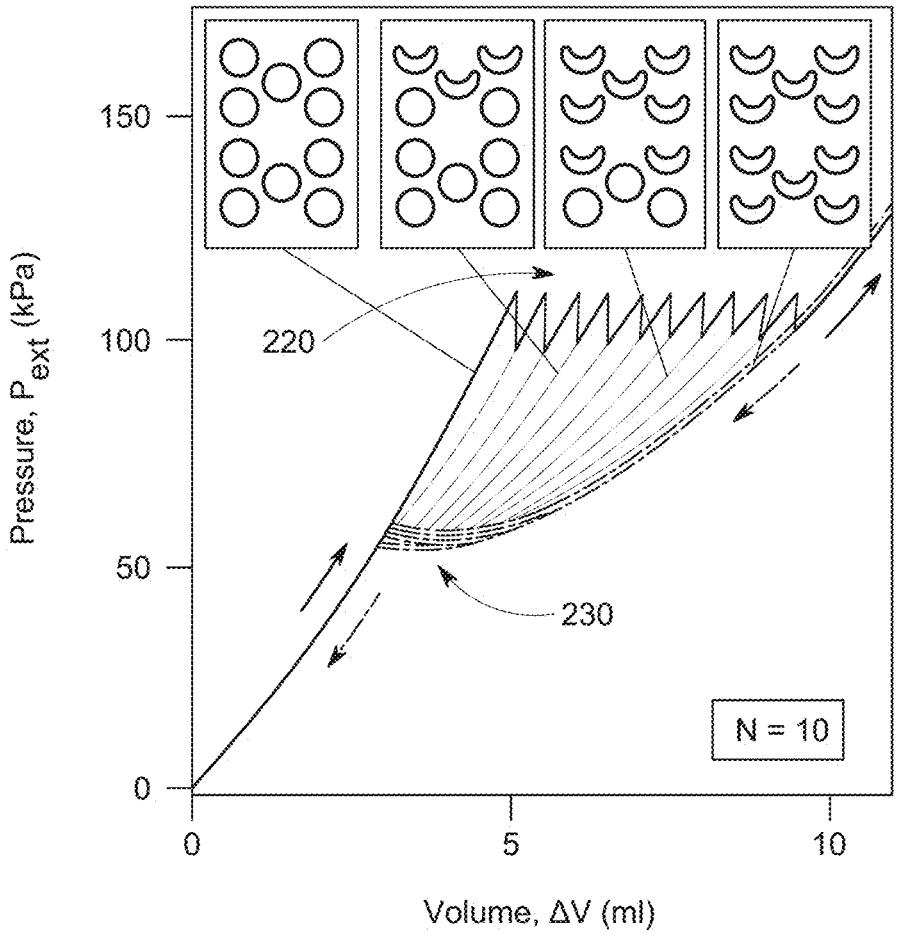
FIG. 8 shows an exemplary graph of pressure vs. volume response for a metafluid having a plurality of compressible capsules, according to certain aspects of the present disclosure.

The pressure vs. volume response of a metafluid 100 having more than one compressible capsule 120 is similar to the response for the metafluid 100 having a single compressible capsule 120. The response in the metafluid having more than one compressible capsule 120 is similar to the one illustrated in FIG. 7, with minor differences. For example, referring to FIG. 8, a graph illustrates an applied pressure in a metafluid 100 having a plurality of compressible capsules 120. In this example, the metafluid 100 has 10 compressible capsules 120, and the applied pressure is on each external shell 150 of the 10 compressible capsules 120. The graph illustrates the applied pressure vs. an incremental increase in volume (ΔV) of the fluid 110. The pressure vs. volume relationship represented in FIG. 8 is qualitatively the same as in FIG. 7. However, a first difference is that the graph of FIG. 8 shows a plurality of pressure decreases 220 instead of the single pressure decrease 180 shown in the graph of FIG. 7. Also, a second difference is that FIG. 8 shows a plurality of pressure increases 230 instead of the single pressure increase 200 shown in FIG. 7.

This result of a plurality of pressure decreases 220 occurs because the buckling of the external shell 150 of each of the compressible capsules 120 results in a corresponding pressure decrease along the plurality of pressure decreases 220. The buckling event for each of the external shells 150 occurs at about the same pressure (e.g., the critical buckling pressure 185). However, because the pressure instantaneously decreases at 220 after each buckling event, the pressure of the metafluid 100 is subsequently increased back to the critical buckling pressure 185. The increase triggers a subsequent buckling event for a subsequent external shell 150.

Similarly, this result of the plurality of pressure increases 230 occurs because the expansion of the external shell 150 of each compressible capsule 120 results in a corresponding pressure increase along the plurality of pressure increases 230. The expansion event for each of the external shells 150 occurs at about the same pressure (e.g., the critical expansion pressure 205). However, because the pressure instantaneously increases at 230 after each expansion event, the pressure of the metafluid 100 is subsequently decreased back to the critical expansion pressure 205 to trigger a subsequent expansion event for a subsequent external shell 150.

Still referring to FIG. 8, in an embodiment having a plurality of compressible capsules 120, the first elastic deformation of the external shell 150 occurs at a constant volume of the metafluid 100. Without being held to theory, this likely occurs because in a metafluid having a plurality of N compressible capsules 120 the sudden reduction of volume experienced by a buckling external shell 150 can be compensated for by a slight expansion in volume of the other N−1 compressible capsules 120.

Figure 9:
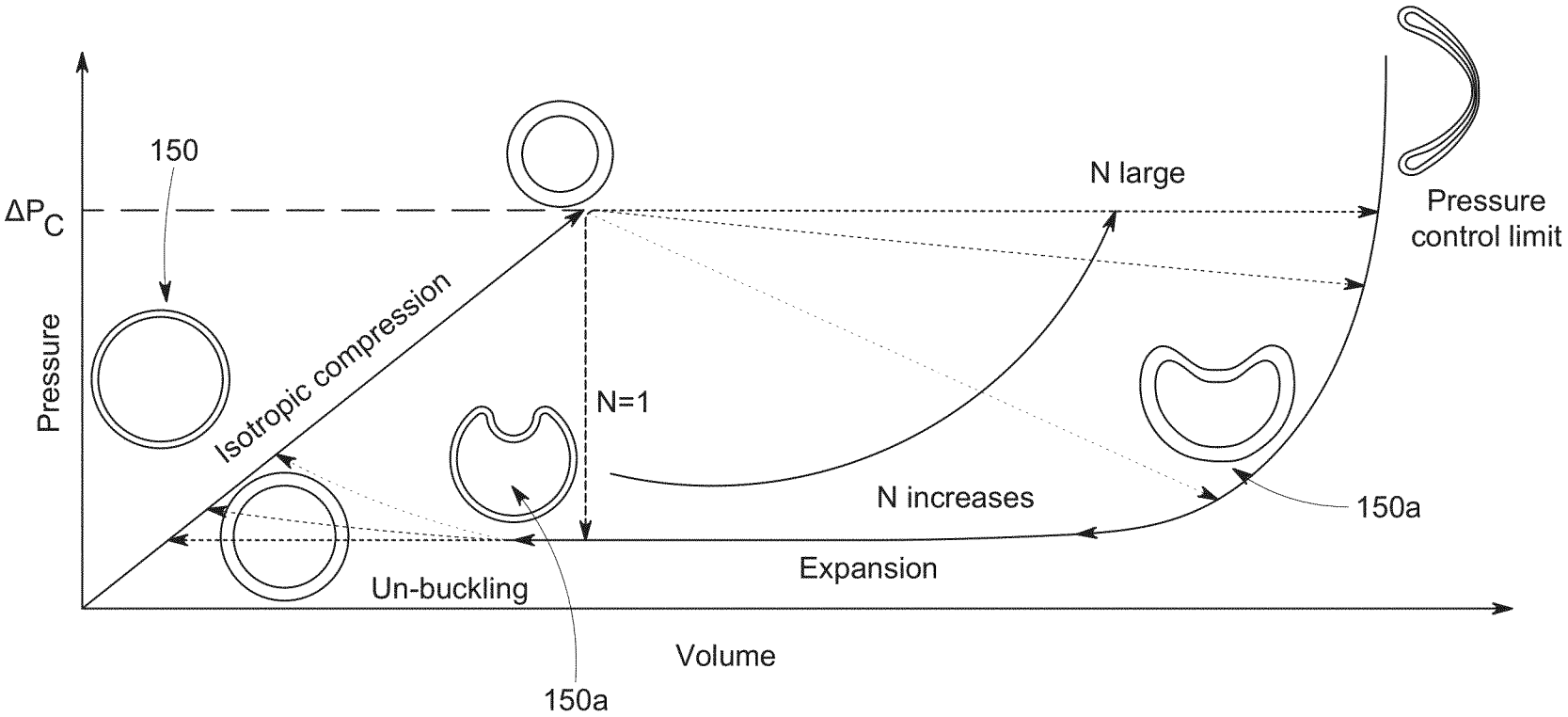
FIG. 9 shows an exemplary graph of pressure vs. volume response representing a decrease in magnitude of pressure, according to certain aspects of the present disclosure

Referring to FIG. 9, it has also been observed that the magnitude of each instantaneous pressure decrease in the plurality of pressure decreases 220 decreases with the number of compressible capsules 120 in the metafluid 100. Notably, a single shell 150 can buckle at either constant volume (when the volume is driven) which generates a vertical drop in pressure in the PV curve, or at constant pressure when the pressure is driven, which generates a horizontal jump in volume in the PV curve. When more shells 150 are introduced and volume is driven, the N−1 shells 150 slightly expand allowing a buckling shell 150*a* to buckle with a behavior between a volume control and a pressure control, generating a jump with an angle. The larger N gets, the more horizontal the line gets, tending to a behavior similar to pressure control.

Further, it has been observed that if a capsule volume fraction φ is defined as a sum of external volumes of the compressible capsules 120 (each having the first shape) and divided by a total volume of the metafluid 100, the critical buckling pressure 185 is independent of the capsule volume fraction φ. This means that the critical buckling pressure 185 for a metafluid 100 having a single compressible capsule 120 is the same as the critical buckling pressure 185 for a metafluid having a plurality of compressible capsules 120, each capsule being the same as the single compressible capsule 120. The difference in the pressure vs. volume response for a single compressible capsule 120 vs. a plurality of compressible capsules 120 is shown respectively in the graphs of FIGS. 7 and 8. In particular, instead of a single instantaneous pressure decrease 180 as shown in FIG. 7 for a single compressible capsule 120, there is a plateau of multiple instantaneous pressure decreases 220 for the metafluid 100 having a plurality of compressible capsules 120.

According to another exemplary embodiment of the metafluid 100, a fluid is fully enclosed within each of the external shells 150. The critical buckling pressure 185 is determined by material properties of the external shell 150, a ratio of the wall thickness, T, to the radius, $R_0$, of the external shell 150, and an internal pressure of the fluid within the external shell 150.

According to another exemplary embodiment of the metafluid 100, the fluid is a gas that is fully enclosed within each of the external shells 150. In one example, the gas is air. The critical buckling pressure 185 is determined by material properties of the external shell 150, a ratio of the wall thickness, T, to the radius, $R_0$, of the external shell 150, and an internal pressure of the gas within the external shell 150.

According to another exemplary embodiment of the metafluid 100, the fluid is a liquid that is fully enclosed within each of the external shells 150. In one example, the liquid is water. The external shells 150, when filled with a liquid do not have a tunable compressibility. The critical buckling pressure 185 for liquid filled external shells is determined by material properties of the external shell 150, a ratio of the wall thickness, T, to the radius, $R_0$, of the external shell 150, and an internal pressure of the liquid within the external shell 150.

According to yet another exemplary embodiment, the metafluid 100 includes a plurality of compressible capsules 120 having two or more subsets of identical capsules. For example, the external shells 150 of a first subset of the plurality of compressible capsules 120 is made from a first material having a first shear modulus and a first ratio of the wall thickness, T, to the radius, $R_0$. The external shells 150 of a second subset of the plurality of compressible capsules 120 is made from a second material having a second shear modulus and a second ratio of the wall thickness, T, to the radius, $R_0$. Differences between the first and second shear moduli and/or between the first and second ratios result in differences in the critical buckling pressure 185 and the critical expansion pressure 205. The result of this arrangement with two subsets of compressible capsules 120 can therefore be a metafluid 100 having two critical buckling pressures 185 and also two critical expansion pressures 205. According to other examples, the metafluid 100 has three or more subsets of identical compressible capsules 120, which results in three or more critical respective buckling pressures 185 and three or more respective critical expansion pressures 205.

An investigation was focused on a suspension of elastomeric and highly deformable spherical capsules enclosing air in an incompressible fluid. A single compressible capsule 120 was fabricated out of silicone rubber (Zhermack Elite Double 32 with initial shear modulus G=0.35 megaPascals (MPa)) using 3D printed molds. The single compressible capsule 120 with outer radius $R_0$=10 mm and thickness T=2 mm was placed in a container with a total volume of 300 milliliters (ml) filled with water, leading to an initial capsule volume fraction φ=0.014.

Figure 10:
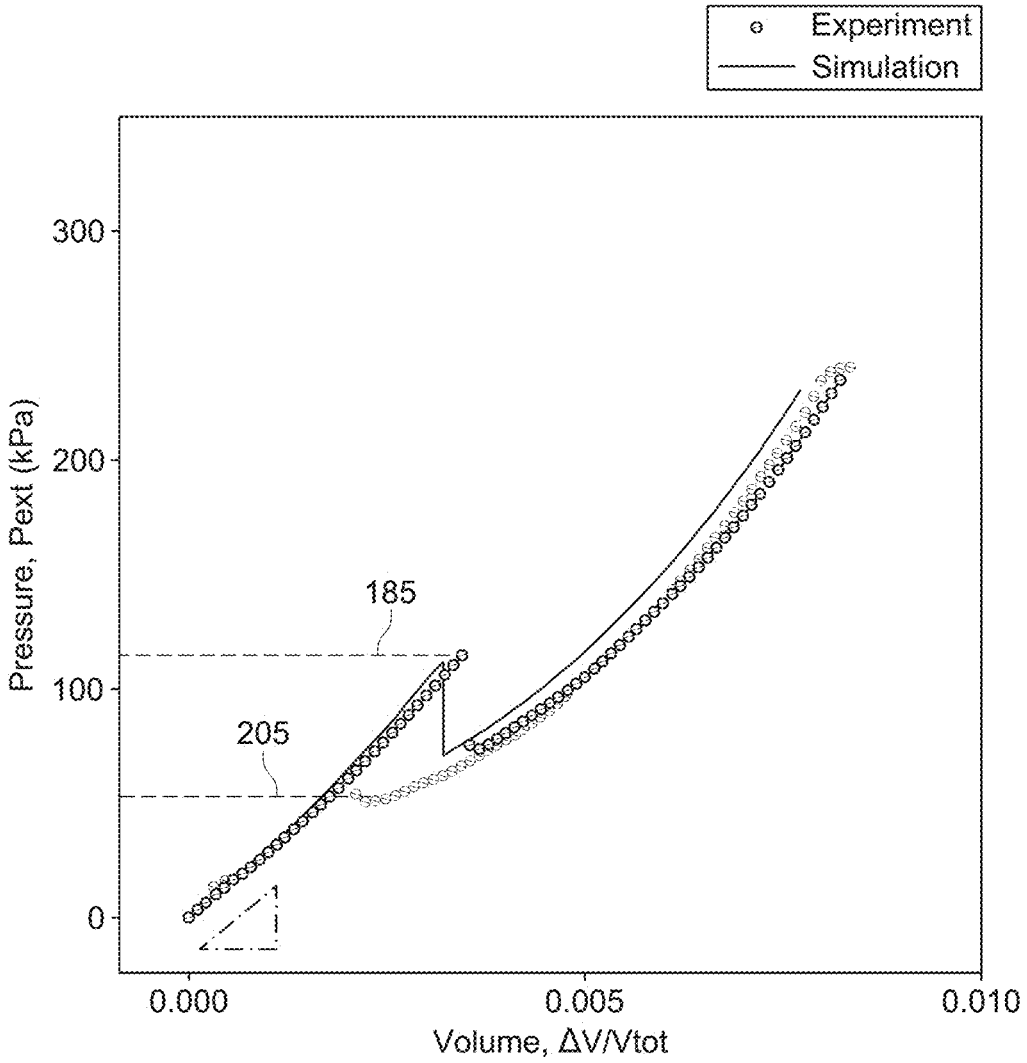
FIG. 10 shows an exemplary graph of pressure vs. volume response for experimental results and simulated results for a metafluid having a single compressible capsule, according to certain aspects of the present disclosure.

Referring to FIG. 10, the recorded pressure-volume curve for the single compressible capsule 120 in water is very different from that of water. This is not only because the compressible capsule 120 makes the fluid more compressible (lowering the initial bulk modulus $K_0$ to 31 MPa), but also because the compressible capsule 120 introduces a sudden pressure drop at P=120 kPa, which is the critical buckling pressure 185. The pressure drop is caused by the snapping of the elastomeric shell and leads to the formation of a dimple (e.g., see the change in shape between FIGS. 3A-3B and 4A-4B). The dimple becomes more accentuated as volume ΔV is increased. When unloading the suspension by decreasing the volume ΔV, the dimple progressively reduces in size and the compressible capsule 120 snaps back to a spherical shape when the pressure passes the threshold of P=50 kPa, which is the critical expansion pressure 205. This difference in the critical buckling pressure 185 and the critical expansion pressure 105 leads to a hysteretic pressure-volume response. It was further observed that $K_0$ and the critical expansion pressure 185 can be tuned independently by varying the capsule volume fraction φ and the ratio of $T/R_0$.

Figure 11:
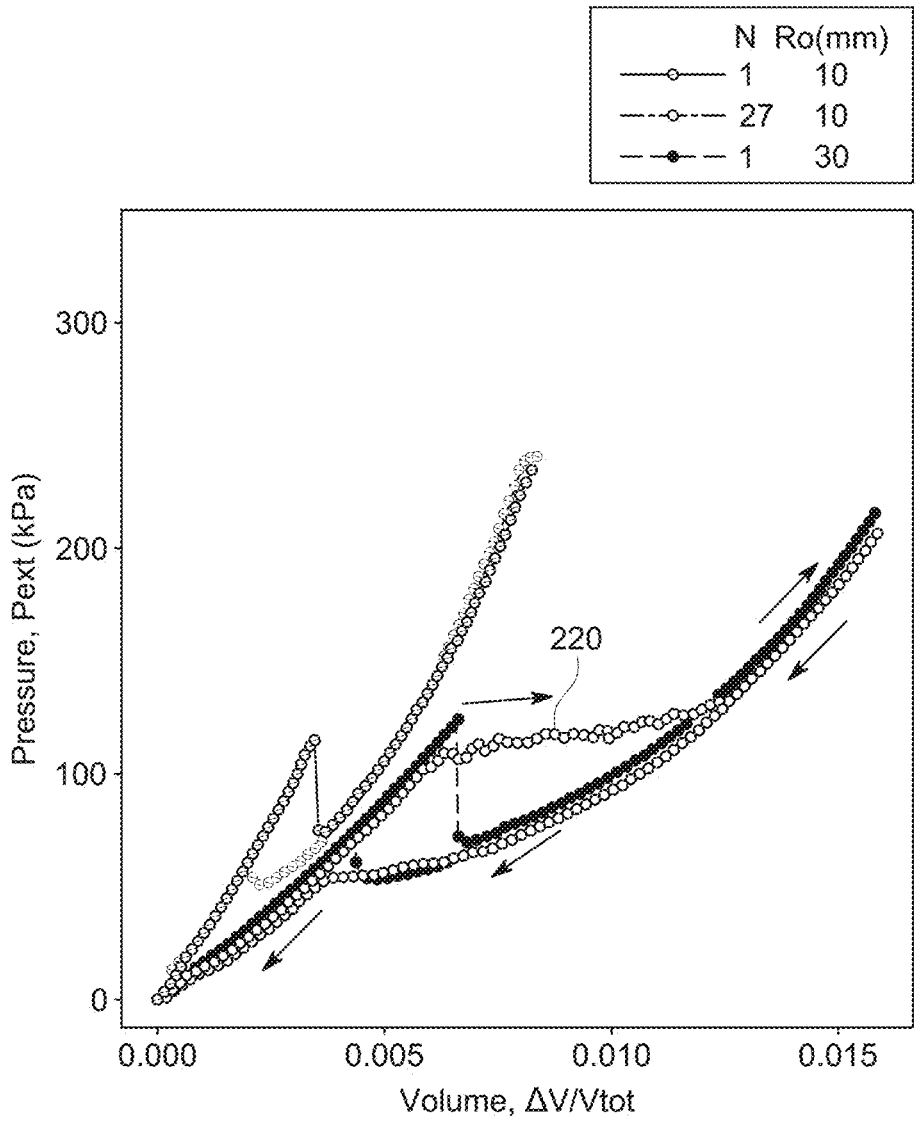
FIG. 11 shows an exemplary graph of pressure vs. volume response for experimental results for a metafluid having a single compressible capsule and a metafluid having a plurality of compressible capsules, according to certain aspects of the present disclosure.

Referring to FIG. 11, the investigation further focused on the effect of a number of compressible capsules 120 by placing N=27 capsules with $R_0$=10 mm and T=2 mm in the same container with a total volume of 2850 ml. In this case, the large snapping-induced pressure drop observed for N=1 is replaced by 27 small drops, where each drop corresponds to the collapse of a single capsule. These individual pressure drops occur at roughly the same pressure such that the plateau 220 emerges.

According to yet another exemplary embodiment, the viscosity of the metafluid 100 as described above is dependent on the pressure of the metafluid 100. The viscosity of the metafluid 100 is also dependent on the shear stress applied to the metafluid 100. For example, while the metafluid 100 is under a relatively low shear stress, the viscosity of the metafluid 100 increases when the pressure applied to the metafluid 100 increases from (i) a pressure that is less than the critical buckling pressure 185 to (ii) the critical buckling pressure 185. Without being held to theory, this result likely occurs because the external surface 160 of each of the compressible capsules 120 has a concave portion upon buckling. The concave portion on each external surface 160 likely changes how the compressible capsules interact by causing clusters to form, which increases the viscosity. However, this increased viscosity is reversible because the external shells 150 can elastically deform back to the first shape when the pressure on the metafluid 100 is reduced to the critical expansion pressure 205. Therefore, when experiencing a relatively low shear stress, the viscosity of the metafluid 100 decreases when the pressure decreases from (i) a pressure that is greater than the critical expansion pressure 205 to (ii) the critical expansion pressure 205.

It has been observed that under a relatively higher shear stress, the metafluid 100 can change from a Newtonian fluid behavior to a non-Newtonian shear thinning fluid behavior. Thus, the viscosity of the metafluid 100 can decrease with increasing shear stress. Without being held to theory, this result likely occurs because the higher or increasing shear stress causes increased external pressure on the compressible capsules 120, which causes buckling. The buckled compressible capsules 120 present a smaller cross-section for sliding past one another, which reduces the viscosity of the metafluid 100. The level of shear stress required to cause the metafluid 100 to transition from a Newtonian fluid to a non-Newtonian fluid is called the transition shear stress, $\sigma_T$. At shear stress levels equal to or greater than the transition shear stress, $\sigma_T$, the metafluid 100 exhibits non-Newtonian shear thinning fluid behavior. The transition shear stress, $\sigma_T$ depends on the size, thickness, fill pressure, fill medium, and material properties of the compressible capsules.

According to another embodiment, the transmittance of light through the metafluid 100 is dependent on the pressure of the metafluid 100. In particular, the transmittance of light through the metafluid 100 increases when the pressure applied to the metafluid 100 increases from (i) a pressure that is less than the critical buckling pressure 185 to (ii) the critical buckling pressure 185. Without being held to theory, this likely occurs because the external surfaces 160 of the compressible capsules 120 have a spherical shape and scatter incident light in multiple directions. In contrast, the external surface 160 of the compressible capsules 120 that have collapsed act generally like a converging lens that focuses the incident light to a single point. However, this increased transmittance of light is reversible because the external shells 150 elastically deform back to the first shape when the pressure on the metafluid 100 is reduced to the critical expansion pressure 205. Therefore, the transmittance of light through the metafluid 100 decreases when the pressure decreases from (i) a pressure that is greater than the critical expansion pressure 205 to (ii) the critical expansion pressure 205.

According to yet another exemplary embodiment, the transmittance of sound through the metafluid 100 having gas-filled compressible capsules 120 is dependent on the pressure of the metafluid 100. In particular, the transmittance of sound through the metafluid 100 increases when the pressure applied to the metafluid 100 increases from (i) a pressure that is less than the critical buckling pressure 185 to (ii) the critical buckling pressure 185. Without being held to theory, it was observed that the metafluid 100 will filter out sound in a range of frequencies from about 20 KiloHertz ("KHz") to about 40 KHz when the compressible capsules 120 are spherical. However, in response to a pressure that is above the critical buckling pressure 185, the compressible capsules 120 are collapsed and no longer spherical. As a result, the previously filtered frequency range of sound is no longer filtered. Again, this increased transmittance of sound is reversible because the external shells 150 can elastically deform back to the first shape (which is spherical in this example) when the pressure on the metafluid 100 is reduced to the critical expansion pressure 205. Therefore, the transmittance of sound through the metafluid 100 decreases when the pressure decreases from (i) a pressure that is greater than the critical expansion pressure 205 to (ii) the critical expansion pressure 205.

Figure 12:
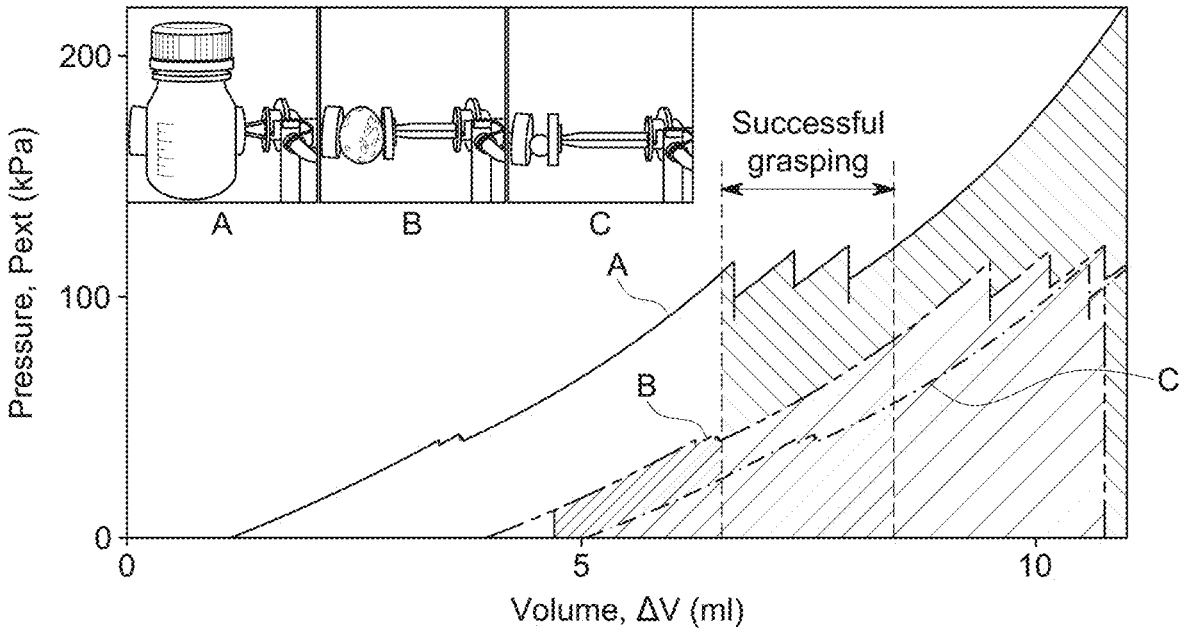
FIG. 12 shows an exemplary graph of pressure vs. volume response for experimental results for a gripper device having a metafluid with two different pluralities of compressible capsules, according to certain aspects of the present disclosure.

In an experiment, the non-linear behavior of the metafluid 100 was harnessed for functionality. The snapping-induced pressure plateau was exploited to realize a gripper device that can grasp objects of very different size and compressive strength when actuated with the same input. More specifically, referring to FIG. 12, the experiment considered a 2-jaw parallel gripper actuated by pressurized fluid, and focused on three distinct objects: A) a glass bottle of 60 mm in diameter and 160 grams (g) in weight, B) an egg of about 25 mm in diameter and about 16 g in weight, and C) a blueberry of about 10 mm in diameter and about 0.5 g in weight. For a successful grasp, the supplied volume $\Delta V$ must be large enough for the actuated jaw to reach the object and hold its weight, but not so large as to generate an excessive force that crushes it. In particular, for the considered bottle, egg, and blueberry, the supplied volume required to reach them and the pressures needed to hold them and crush them are measured as $\Delta V_{reach} \approx 1.1$, 3.9 and 5.1 ml, $P_{hold} \approx 110$, 12, and 1 kPa and $P_{crush} \approx 700$, 105 and 55 kPa, respectively.

When using water or air as fluid to actuate the jaw, no $\Delta V$ can be identified that allows us to successfully grasp all three objects. By contrast, when using a metafluid with $K_0$=2 MPa and two plateaus at 45 and 120 kPa (realized by filling a container with $V_{tot}$=100 ml with water and six capsules with T=2 mm, $R_0$=10 mm, three made out of rubber with G=60 kPa and three out of rubber with G=350 kPa), we could successfully grasp all three objects by injecting $\Delta V$=6.7 ml.

Figure 13:
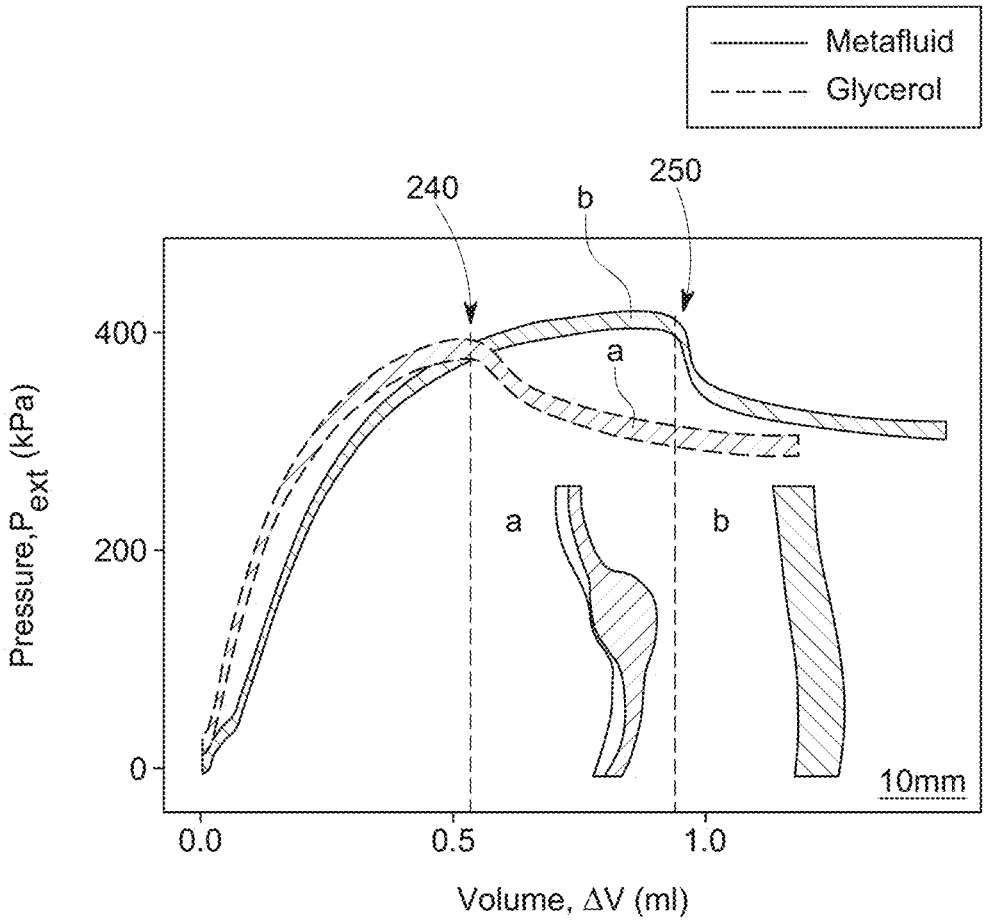
FIG. 13 shows an exemplary graph of pressure vs. volume response for experimental results for a flexible latex tube pressurized by a metafluid, according to certain aspects of the present disclosure.

While centimeter-scale capsules enclosed in a separate container can be used to regulate the pressure of the fluid, such an independent pressure reservoir is unnecessary when utilizing a micro-suspension, because the micro-suspension can be directly placed in the functional components. To demonstrate this, a micro-suspension of micrometer-scale capsules with a capsule volume fraction $\varphi$ of about 0.3 suspended in silicone oil was used to directly pressurize a flexible latex tube (shear modulus G≈1 MPa) with outer diameter of 5.1 mm, thickness of 1.9 mm and length of 48 mm. As shown by the line labeled as "a" in the plot of FIG. 13, such a tube undergoes a ballooning instability at a critical buckling pressure of 400 kPa, which upon inflation with glycerol is reached for $\Delta V$ of about 0.53 ml. The ballooning instability is shown on the tube labeled as "a" superimposed on the plot, and is indicated by arrow 240 in FIG. 13. However, as shown by the line labeled as "b" in the plot of FIG. 13, when the tube is pressurized by the micro-suspension, the compliance and pressure plateau of the micro-suspension offset the ballooning instability to $\Delta V$ of about 0.94 ml, as is indicated by arrow 250 in FIG. 13. This offset of the ballooning instability shows that the nonlinear behavior of the capsules also provides opportunity to tune the interactions of the metafluid with surrounding flexible structures.

Figure 14:
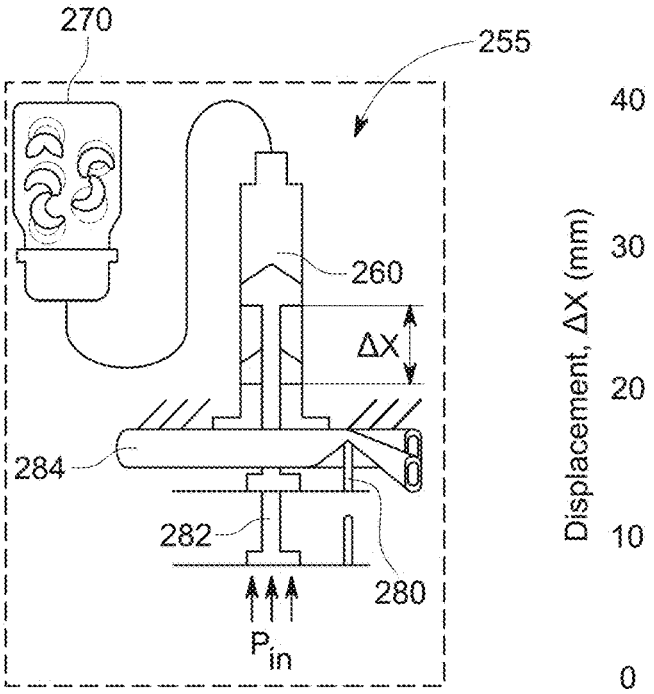
FIG. 14 shows a schematic diagram representative of a tunable flow switch, according to certain aspects of the present disclosure.

The sudden change in ΔV triggered at the critical buckling pressure under pressure controlled conditions can also be used to realize reconfigurable logic elements. To this end, the highly nonlinear response of a metafluid was first exploited to design a tunable flow switch 255. Referring to FIG. 14, the switch 255 is realized by connecting a syringe 260 to a container 270 with $V_{tot}$=100 ml filled with the metafluid 100 and attaching a blade 280 to its plunger flange 282. An elastomeric tube 284 is connected to the syringe's barrel flange and a pressure controller (Fluigent Flow EZ™ 7 bar) is used to apply input pressure $P_{in}$ to the external side of the syringe's plunger. As the input pressure $P_{in}$ is increased, the plunger flange 282 and the blade 280 move by ΔX until the blade 280 flattens the soft elastomeric tube 284 and completely stops the flow through it (for ΔX=28 mm). It is important to note that the characteristics of the switch 255 are determined by the properties of the metafluid 100 in the container.

Figure 15:
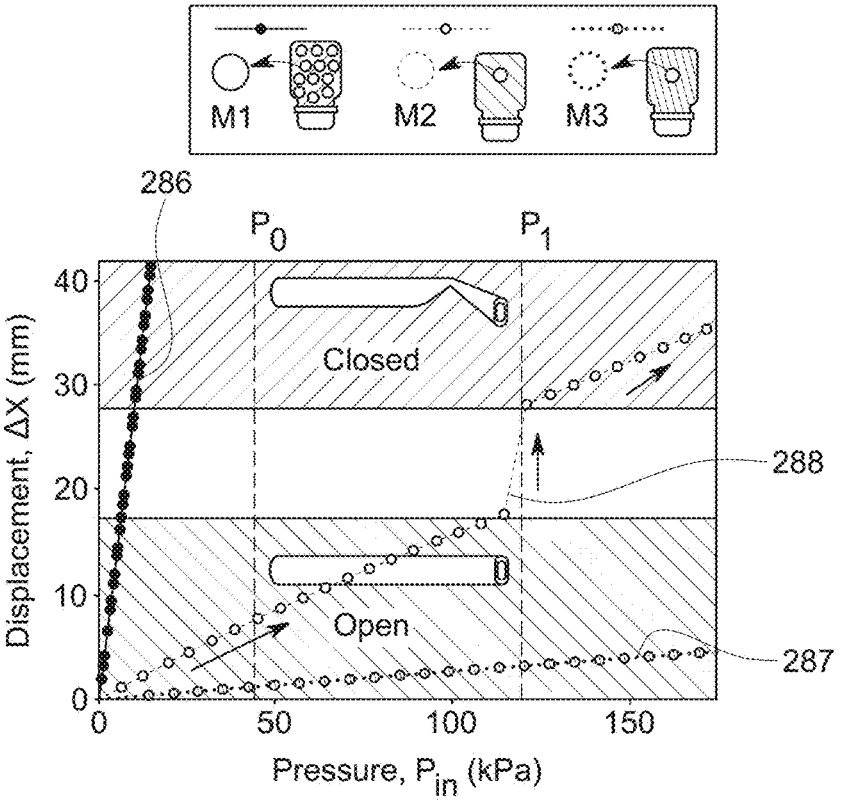
FIG. 15 shows an exemplary graph of pressure vs. volume response for experimental results for the tunable flow switch of FIG. 14 for three different metafluids, according to certain aspects of the present disclosure.

Referring to FIG. 15, to demonstrate this point, we considered three metafluids:

(M1): $K_0$=0.9 MPa and critical buckling pressure=45 kPa (realized by filling the container with water and 12 shells with G=60 kPa, T=2 mm and $R_0$=10 mm);

(M2): $K_0$=18 MPa and critical buckling pressure=120 kPa (realized by filling the container with water and one shell with G=350 kPa, T=2 mm and $R_0$=10 mm); and (M3): $K_0$=140 MPa and critical buckling pressure=590 kPa (realized by filling the container with water and one shell with G=350 kPa, T=4.5 mm and $R_0$=10 mm).

The initial bulk modulus of metafluid M1 is low enough to make the switch 255 close before the input pressure $P_{in}=P_0$=45 kPa (line 286), whereas that of metafluid M3 is large enough to keep the switch 255 open both at $P_0$ and $P_{in}=P_1$=120 kPa (line 287). Differently, for metafluid M2 the snapping of the capsule triggers a large ΔX that suddenly stops the flow through the soft tube at $P_1$=120 kPa (line 288).

Figure 16:
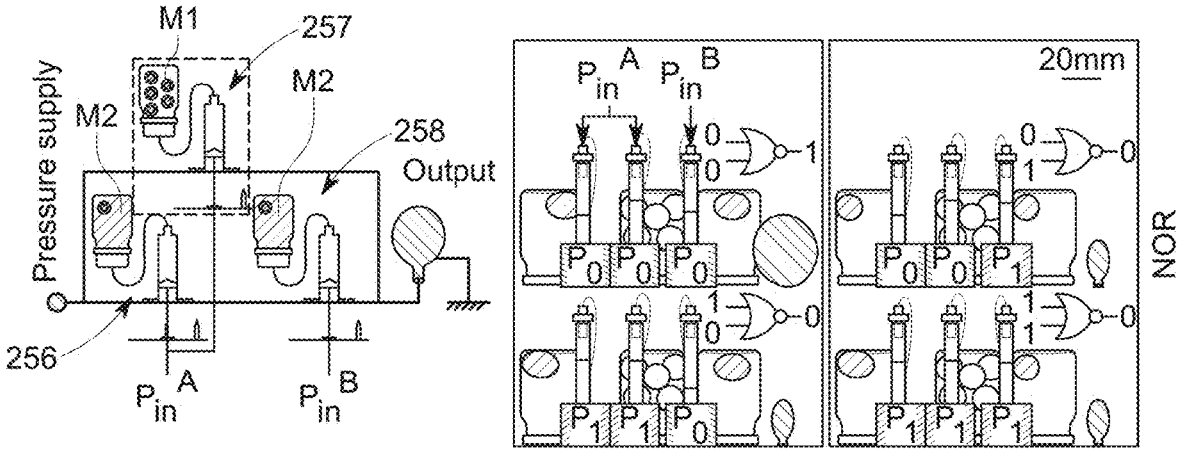
FIG. 16 shows a schematic diagram representative of a NOR gate made from three tunable flow switches, and operational states of the NOR gate, according to certain aspects of the present disclosure.
Figure 17:
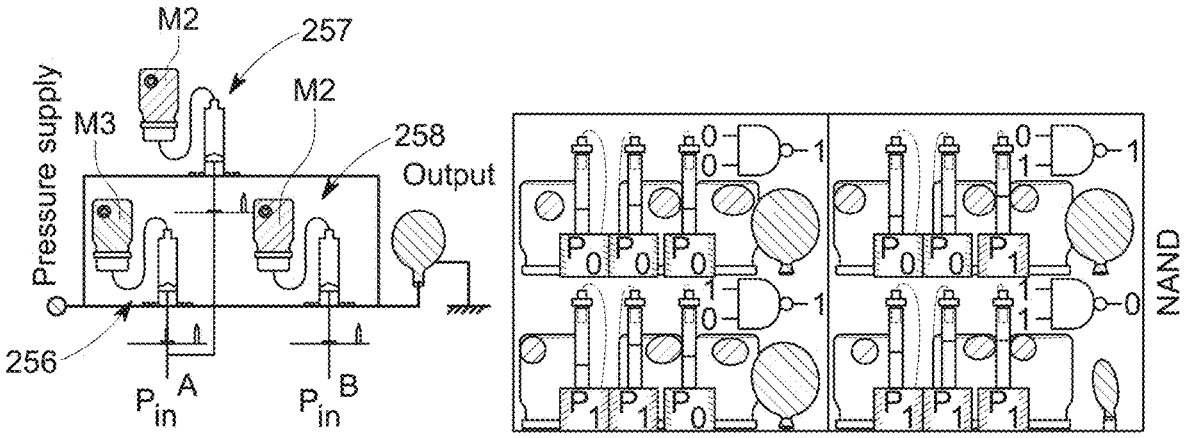
FIG. 17 shows a schematic diagram representative of a NAND gate made from three tunable flow switches, and operational states of the NAND gate, according to certain aspects of the present disclosure.

Referring generally to FIGS. 16 and 17, we combine switches 255 based on the three metafluids M1, M2, and M3 to design reconfigurable logic gates. To help distinguish between the three switches 255 in FIGS. 16 and 17 they will be referred to as the first switch 256, the second switch 257, and the third switch 258. In particular, we consider two soft tubes 284 both connected at their end to a balloon (which allows us to read the state of the gate) and to a pressure supply and distribute three switches 255 along them. Switches 256 and 257 are actuated by the same input pressure $P^A$ and the switch 258 is actuated by the input pressure by $P^B$. We define input logical states 0 and 1 as $P_{in}=P_0$ and $P_{in}=P_1$, respectively.

Referring in particular to FIG. 16, we can realize a NOR gate by connecting the first and third switches 256 and 258 arranged in series on one of the soft tubes 284 to metafluid M2 and the second switch 257 to metafluid M1. Referring in particular to FIG. 16, remarkably, the very same system becomes a logical NAND gate when for the second switch 257 we simply replace M1 connected to $P^A$ with M2, and for the first switch 256 we replace M2 connected to $P^A$ with M3. It should be noted that, since both NAND and NOR gates are functionally complete, they can be combined to construct many other logic circuits whose function can be reprogrammed by simply changing the metafluid connected to the switches 256, 257, and 258.

Figure 18:
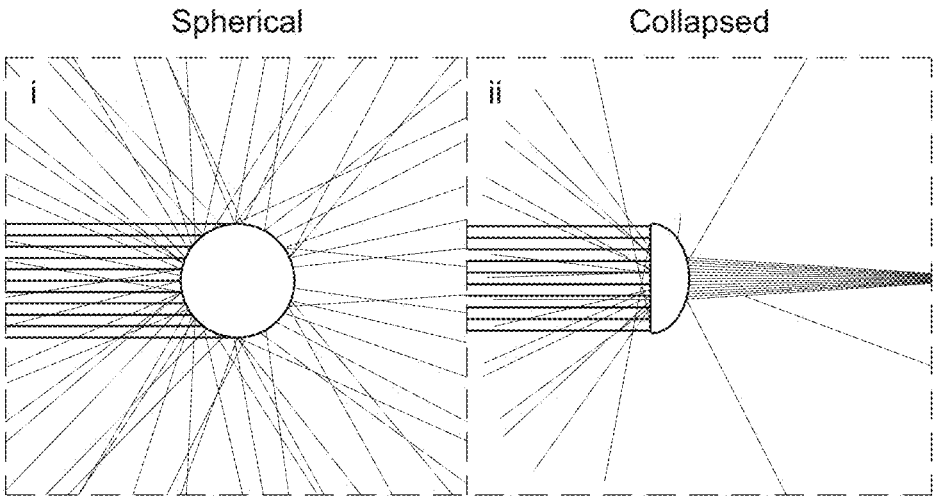
FIG. 18 shows a schematic diagram representative of simulated scattering of incident light rays in spherical and collapsed compressible capsules, according to certain aspects of the present disclosure.

Apart from the non-linear pressure-volume curve, the substantial alterations in the shape of the compressible capsule 120 induced by instability also present opportunities for functionality. Inspired by the configuration-dependent interactions with light observed for droplets, we investigated the effect of the pronounced dimple caused by buckling on the optical properties of the metafluid 100. To this end, we conducted simulations in COMSOL® using a ray-tracing algorithm. As shown in FIG. 18, it was observed that spherical capsules scatter the incident rays in multiple directions while collapsed capsules act as converging lenses that focus the incident rays to a single point.

Figure 19:
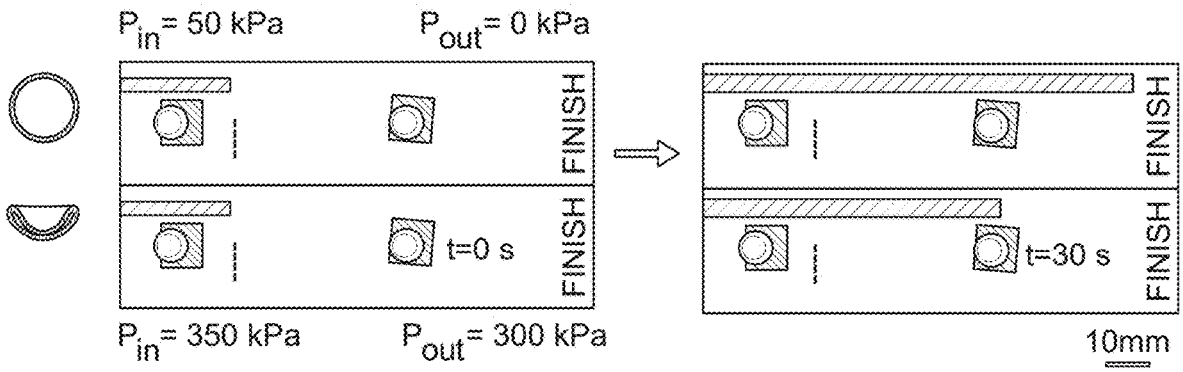
FIG. 19 shows a schematic diagram representative of an experimental setup for measuring the velocity of a metafluid through a tube for a fixed pressure drop but for various input pressures, according to certain aspects of the present disclosure.
Figure 20:
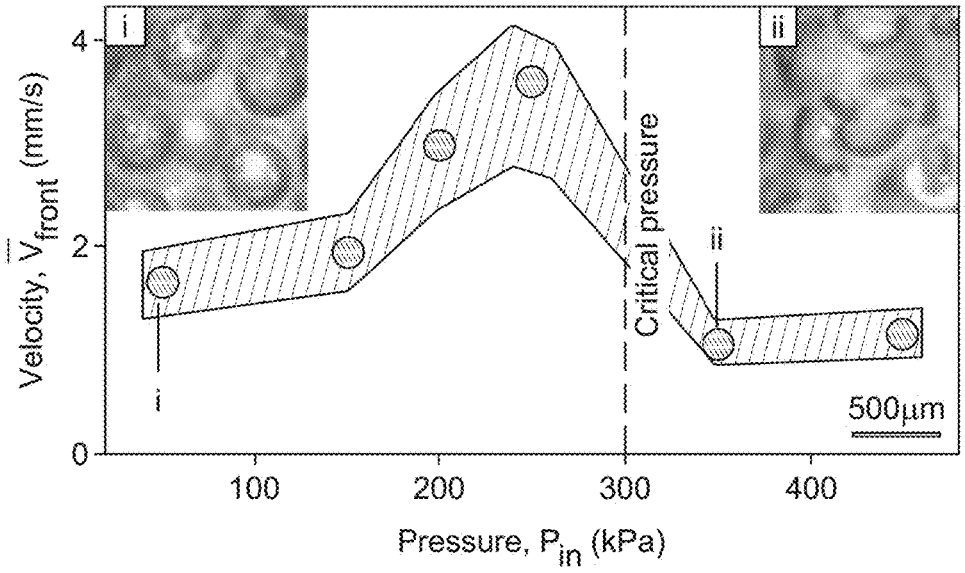
FIG. 20 shows an exemplary graph of experimental results for average velocity of a metafluid through a tube for a fixed pressure drop but for various input pressures, according to certain aspects of the present disclosure.

The buckling-induced shape change of the compressible capsules 120 also modifies the way in which the metafluid 100 flows. To demonstrate this point, we consider a micro-suspension with a capsule volume fraction φ of about 0.3 and a critical buckling pressure of 300 kPa, and investigate its flow in an elliptical channel with major axis of 3 mm and minor axis of 750 μm. Referring to FIG. 19, we fixed the difference of pressure between the inlet and outlet at $\Delta P=P_{in}-P_{out}$=50 kPa and conducted experiments for $P_{in}\in$ [50, 450] kPa. For each experiment, we monitored the position of a front of the micro-suspension once the flow is fully developed and then calculate its average velocity, $V_{front}$. Referring to FIG. 20, we observed that for $50\leq P_{in}\leq 250$ kPa the average velocity of the front increases with the pressure at the inlet. For this range of $P_{in}$ the compressible capsules 120 retain their spherical shape and isotropically shrink as the pressure increases, leading to a decreasing effective capsule volume fraction φ and, in turn, to a faster flow. However, when the pressure is high enough to snap the capsules, $V_{front}$ largely decreases. The unexpected drop in flow velocity can be explained by the formation of a dimple upon buckling, which causes the compressible capsules 120 to adopt a concave shape. This concave shape significantly modifies the interactions between particles, resulting in the formation of clusters and aggregates that ultimately slow down the flow. If we assume laminar flow in the tube and use Hagen-Poiseuille law, we can estimate the apparent viscosity of the metafluid 100 to suddenly increase from η≈0.4 Pascal seconds (Pa s) to η≈1.3 Pa s after the compressible capsules 120 snap. This observation is also confirmed by rheological measurements. Importantly, this transition is reversible and repeatable since the shape change of the compressible capsules 120 is driven by an elastic instability.

In summary, we have successfully demonstrated the potential of utilizing reversible buckling of elastomeric shells to create a novel class of metafluids. These metafluids exhibit nonlinear elasticity, switchable optical properties, and adjustable viscosity. The versatility of these metafluids opens up numerous opportunities for functionality, as demonstrated by the development of adaptable grippers and reconfigurable logic gates. Further, the range of applications for such metafluids could be expanded by establishing an inverse design platform capable of identifying shell mixtures that yield desired responses. For example, inversely designed metafluids with complex nonlinear behavior could be used to modify the functionality of soft actuators by simply changing the actuating fluid instead of redesigning the actuator itself for the new task. Further, they could pave the way towards smart hydraulic shock absorbers with dissipation tailored to the profile of the shock. Finally while this study primarily focused on situations involving slow loading, dynamic pressure drops across the metafluid could open up opportunities for a spatial avalanche of snapping events and interesting wave propagation.

Although the disclosed embodiments have been illustrated and described with respect to one or more implementations, equivalent alterations and modifications will occur or be known to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

While various embodiments of the present disclosure have been described above, it should be understood that they have been presented by way of example only, and not limitation. Numerous changes to the disclosed embodiments can be made in accordance with the disclosure herein, without departing from the spirit or scope of the disclosure. Thus, the breadth and scope of the present disclosure should not be limited by any of the above described embodiments. Rather, the scope of the disclosure should be defined in accordance with the following claims and their equivalents.

What is claimed is:

1. A metafluid, comprising:

a fluid exposed to a plurality of loads, each load of the plurality of loads causing a respective pressure change within the fluid; and one or more compressible capsules suspended within the fluid, each capsule of the one or more compressible capsules having an external shell that has an external surface in the form of a single, continuous surface configured to withstand a cyclic elastic buckling deformation, the external shell changing between a first shape and a second shape in response to elastic buckling instability of the external shell in its entirety, the elastic buckling instability being caused by application of a predetermined load of the plurality of loads, the first shape being an original shape, the second shape being a buckled shape.

2. The metafluid of claim 1, wherein the external shell has an enclosed internal volume and is deformable under pressure to withstand a first elastic deformation from the first shape to the second shape, the external shell being further deformable under pressure to withstand a second elastic deformation from the second shape to the first shape.

3. The metafluid of claim 2, wherein the first elastic deformation occurs at a constant volume or a constant pressure of the metafluid.

4. The metafluid of claim 2, wherein the first shape is an original shape and the second shape is a deformed shape, the first elastic deformation being the result of increasing the pressure from less than a critical buckling pressure to the critical buckling pressure, the second elastic deformation being the result of decreasing the pressure from more than a critical expansion pressure to the critical expansion pressure.

5. The metafluid of claim 4, wherein the deformed shape is one of a plurality of deformed shapes.

6. The metafluid of claim 5, wherein the internal volume of the deformed shape decreases with increasing the pressure.

7. The metafluid of claim 4, wherein the critical expansion pressure is less than the critical buckling pressure.

8. The metafluid of claim 4, wherein a capsule volume fraction is defined as a sum of external volumes of the one or more compressible capsules each having the first shape divided by a total volume of the metafluid, and wherein the critical buckling pressure is independent of the capsule volume fraction.

9. The metafluid of claim 4, wherein a viscosity of the metafluid is dependent on the pressure of the metafluid.

10. The metafluid of claim 9, wherein the viscosity of the metafluid increases when the pressure increases from less than the critical buckling pressure to the critical buckling pressure, and wherein the viscosity of the metafluid decreases when the pressure decreases from more than the critical expansion pressure to the critical expansion pressure.

11. The metafluid of claim 4, wherein the viscosity of the metafluid is dependent on the shear stress applied to the metafluid.

12. The metafluid of claim 11, wherein the metafluid exhibits non-Newtonian shear thinning fluid behavior at a shear stress equal to or greater than the transition shear stress, $\sigma_T$.

13. The metafluid of claim 4, wherein transmittance of light through the metafluid is dependent on the pressure of the metafluid.

14. The metafluid of claim 13, wherein the transmittance of light through the metafluid increases when the pressure increases from less than the critical buckling pressure to the critical buckling pressure, and wherein the transmittance of light through the metafluid decreases when the pressure decreases from more than the critical expansion pressure to the critical expansion pressure.

15. The metafluid of claim 4, wherein transmittance of sound through the metafluid is dependent on the pressure of the metafluid.

16. The metafluid of claim 15, wherein the transmittance of sound through the metafluid increases when the pressure increases from less than the critical buckling pressure to the critical buckling pressure, and wherein the transmittance of sound through the metafluid decreases when the pressure decreases from more than the critical expansion pressure to the critical expansion pressure.

17. The metafluid of claim 4, wherein a gas is fully enclosed within the external shell.

18. The metafluid of claim 17, wherein the gas is air.

19. The metafluid of claim 17, wherein the critical buckling pressure is determined by material properties of the external shell, a ratio of the wall thickness to the radius of the external shell, and an internal pressure of the gas within the external shell.

20. The metafluid of claim 4, wherein a liquid is fully enclosed within the external shell.

21. The metafluid of claim 20, wherein the liquid is water.

22. The metafluid of claim 20, wherein the critical buckling pressure is determined by material properties of the external shell, a ratio of the wall thickness to the radius of the external shell, and an internal pressure of the liquid within the external shell.

23. The metafluid of claim 1, wherein the one or more compressible capsules are spherical.

24. The metafluid of claim 1, wherein the external shell of a first subset of the one or more compressible capsules is made from a first material having a first shear modulus and a first ratio of the wall thickness to the radius of the external shell, and the external shell of a second subset of the one or more compressible capsules is made from a second material having a second shear modulus and a second ratio of the wall thickness to the radius of the external shell.

* * * * *